United States Patent [19]

Laforest

[11] 4,357,724

[45] Nov. 9, 1982

[54] PNEUMATIC CORE FOR ADJUSTABLE FIRMNESS OF MATTRESSES, CUSHIONS AND THE LIKE

[76] Inventor: Guy Laforest, 7752 Place Arundel, Anjou, Canada, H1K 3S6

[21] Appl. No.: 172,004

[22] Filed: Jul. 24, 1980

[51] Int. Cl.[3] ..... A47C 27/08; A47C 23/04

[52] U.S. Cl. ..... 5/449; 5/475; 5/478; 297/DIG. 3

[58] Field of Search ..... 5/450, 481, 448, 478, 5/455, 449, 441, 475; 297/DIG. 3, DIG. 8

[56] References Cited

U.S. PATENT DOCUMENTS

| | | | |
|---|---|---|---|
| 1,928,675 | 10/1933 | Sampson | 5/450 |
| 2,521,530 | 9/1950 | McGuffage | 5/449 |
| 2,691,179 | 10/1954 | Kann | 5/450 |
| 2,748,399 | 6/1956 | Rockoff | 5/450 |
| 2,814,053 | 11/1957 | Sevcik | 5/450 |
| 3,045,257 | 7/1962 | Knapp | 5/449 |
| 3,110,520 | 11/1963 | Herding | 5/450 |
| 3,736,027 | 5/1973 | Stafford | 5/449 |
| 4,076,872 | 2/1978 | Lewicki et al. | 5/449 |

*Primary Examiner*—Alexander Grosz

[57] ABSTRACT

A pneumatic core for mattresses, cushions, car seats and the like, is disclosed. The core comprises an upper sheet of rubberized cloth and a lower sheet of flexible rubber material forming a plurality of protrusions when inflated.

2 Claims, 3 Drawing Figures

PNEUMATIC CORE FOR ADJUSTABLE FIRMNESS OF MATTRESSES, CUSHIONS AND THE LIKE

This invention relates to mattresses, chesterfield cushions, car seats and the like, and more particularly to means for adjusting the degree of firmness of mattresses, cushions, car seats and the like.

Mattresses, cushions, car seats and the like are generally supplied in different degree of firmness, and it is generally impossible to change such degree of firmness of the article once it has been built.

It has been proposed in U.S. Pat. No. 2,000,873 to insert a pneumatic core into a mattress to modify the cushioning properties of the mattress. However, such pneumatic core lacks stability and, in addition, is not well suited to inner spring mattresses, cushions and the like.

It is therefore the object of the present invention to provide a pneumatic core for use with mattresses, cushions and the like of all types, including those having an inner coil spring structure, which permits adjustment of the firmness while maintaining the lateral stability of the article and avoiding uneven firmness on the top of the article.

The pneumatic core in accordance with the invention comprises an upper sheet of rubberized, non-elastic cloth and a lower sheet of flexible and elastic rubber material having a plurality of protrusions adapted to be inserted in at least some of the openings of the coil springs of the inner spring structure, or adapted to extend within the compressible material of either types of mattresses or the like.

A padding is preferably glued to the upper sheet of the core and the padding, pneumatic core and inner coil spring structure, if any, placed inside a suitable cover.

The invention will now be disclosed, by way of example, with reference to the accompanying drawings, in which.

Figure 1:
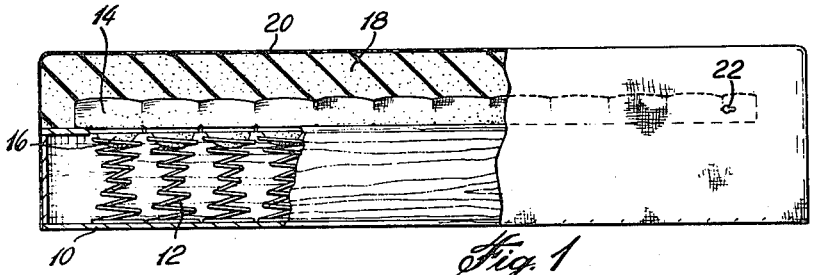
FIG. 1 is a side view, partly shown in the section of a mattress, incorporating a pneumatic core in accordance with the invention.
Figure 2:
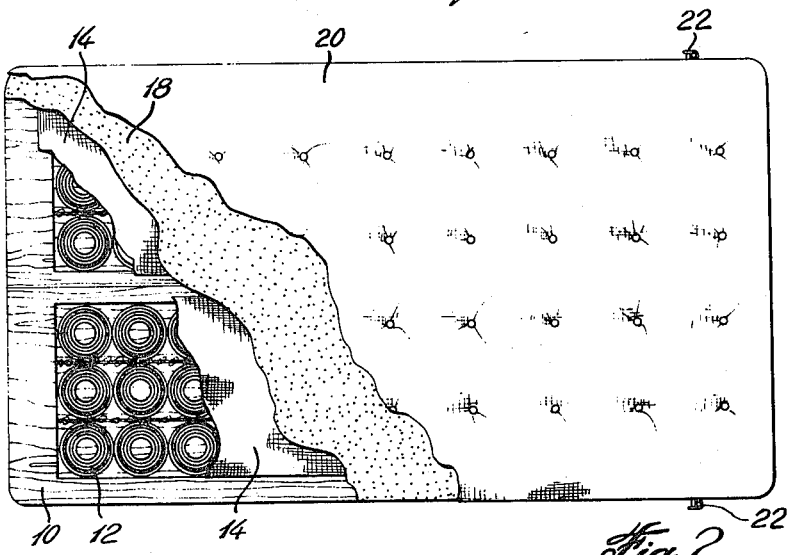
FIG. 2 illustrates a top view, partly in section, of the mattress shown in FIG. 1.
Figure 3:
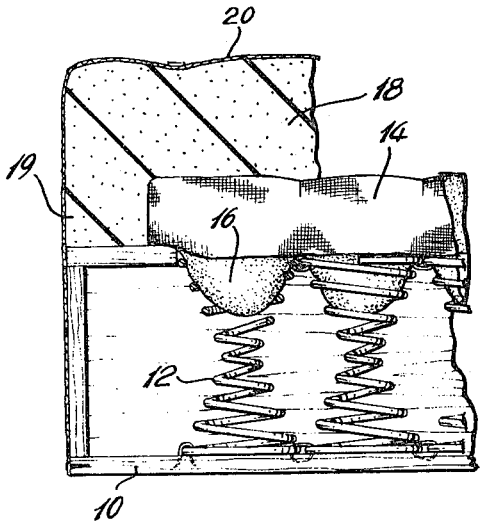
FIG. 3 shows an enlarged view of a portion of the mattress shown in FIG. 1.

Referring to the drawings, there is shown an inner coil spring mattress having a rectangular wooden box frame 10, upon which are secured a plurality of coil springs 12 in known manner. The mattress is divided in two longitudinal spring sections for the comfort of two persons sleeping in the same bed. A separate pneumatic core is placed over each individual spring section. Each pneumatic core comprises an upper sheet 14, made of a rubberized, non-elastic cloth, and a lower sheet 16, made of flexible, elastic rubber material having a plurality of protrusions therein adapted to be inserted in at least some of the openings in the coil springs 12 to ensure lateral stability of the mattress. A padding 18, of suitable material, such as foam, is glued, or otherwise secured, to the upper sheet of the pneumatic core and its marginal portion 19 surrounds the pneumatic core and is secured to frame 10 to further ensure lateral stability of the mattress. An overall cover 20 is placed over the padding, core and mattress structure.

The main advantage of the pneumatic core in accordance with the invention is that the protrusions in the core provide a great amount of stability of the mattress, while permitting to adjust the degree of firmness by inflating the pneumatic core to a suitable pressure by means of valves 22 and avoiding uneven firmness at the top surface of the mattress, or the like, since the upper sheet 14 remains substantially flat when the core is inflated.

In the preferred embodiment shown in the drawings, each section of the mattress may be inflated to a pressure providing the most comfortable sleeping position to the person sleeping on that portion of the mattress.

Although the invention has been disclosed with reference to a mattress having two separate pneumatic cores, it is to be understood that a single pneumatic core could be used.

It is also to be understood that the present invention is not limited to mattresses, but that the pneumatic core could be used for chesterfield cushions, car seats and other devices having, or not, an inner coil spring structure.

What I claim is:

1. In a combination with a mattress, cushion, car seats and the like articles, having an inner coil spring structure, a pneumatic core overlying said structure and comprising an upper sheet of rubberized, non-elastic cloth and a lower sheet of flexible, elastic rubber forming a plurality of protrusions inserted in the openings of the coil springs of said inner coil spring structure.

2. The combination as defined in claim 1, further including a padding overlying and glued to the upper sheet of rubberized cloth and a cover placed over the overall padding, core and inner coil spring structure.

* * * * *